US007673371B1

(12) United States Patent
Shahbaz

(10) Patent No.: US 7,673,371 B1
(45) Date of Patent: Mar. 9, 2010

(54) VACUUM BROOM APPARATUS

(75) Inventor: Jamshid Jim Shahbaz, Westlake Village, CA (US)

(73) Assignee: H & J Company LLC, Los Angeles, CA (US)

( * ) Notice: Subject to any disclaimer, the term of this patent is extended or adjusted under 35 U.S.C. 154(b) by 1279 days.

(21) Appl. No.: 11/117,273

(22) Filed: Apr. 28, 2005

Related U.S. Application Data

(63) Continuation-in-part of application No. 10/315,956, filed on Dec. 10, 2002, now abandoned.

(51) Int. Cl.
*A47L 9/06* (2006.01)

(52) U.S. Cl. ..... 15/398; 15/367; 15/327.5

(58) Field of Classification Search ..... 15/327.5, 15/367, 398–400
See application file for complete search history.

(56) References Cited

U.S. PATENT DOCUMENTS 1,971,493 A * 8/1934 Leathers ..... 15/369
2,350,949 A * 6/1944 Weimers ..... 15/399
3,286,446 A * 11/1966 Happe et. al. ..... 55/357
4,279,095 A * 7/1981 Aasen ..... 43/139
4,956,892 A * 9/1990 Fawkes ..... 15/339
5,267,371 A * 12/1993 Soler et al. ..... 15/327.5
5,345,651 A * 9/1994 Roberts ..... 15/397
5,428,854 A * 7/1995 Rief et al. ..... 15/1.7
5,697,920 A * 12/1997 Gibbons ..... 604/289
5,722,112 A * 3/1998 Scanni et al. ..... 15/344
6,029,311 A * 2/2000 Scanni et al. ..... 15/344
6,044,521 A * 4/2000 Sebek ..... 15/393
6,553,610 B1 * 4/2003 Shideler ..... 15/327.5

* cited by examiner

*Primary Examiner*—Shay L Karls
(74) *Attorney, Agent, or Firm*—William L. Chapin

(57) ABSTRACT

A vacuum broom apparatus for removing particulate debris from surfaces such as those of floors includes a housing which has an upper wall from which protrudes a vacuum inlet tube connectable to a vacuum power source. The housing includes a shroud which protrudes downwardly from the upper wall and peripherally surrounds a broom which protrudes downwardly within the shroud through a bottom opening thereof. One or more vacuum nozzles which communicate with the vacuum inlet tube are positioned adjacent to the broom. Optionally, a front wall of the shroud is elastically flexible to thereby effect an air dam between a lower edge of the front wall and a floor surface against which it may be pressed. Also, the broom may take the form of a block which at least partly encloses a lower entrance opening of the shroud, the block having a lower surface from which bristles protrude downwardly, and a plurality of vacuum passageways interspersed within the bristles and which have lower debris entrance openings in the lower surface of the block, and upper debris exit openings through an upper surface of the block which communicates with a negative pressure region of an interior region of the shroud.

4 Claims, 9 Drawing Sheets

50
58
59
110
108
5
57
111
56
4
55
9,10
142T
54
135
53
136
142
51
137
52
131
143
130
132
139
9,10
125
123
122
56
-114-
121
126
129
55
54
-120-
128
119
-109-
108
118
115
57
113
112
-114-
111
116
117
114

129
54
120
166
168
152
142T
143
167
153
152A
154
163
51
155A
144
142
137
149
156
158
157
148
138
139
160

129
54
120
166
168
150
142T
152
170
143
169
151
153
152A
162
51
144
142
159
137
149
148
158
138
139
165
161
160

129
54
142T
51
137
130
131
132
141
140
139

120
129
54
51
137
143
130
144
132
145
131
161
140
140
139
165
160

166A
195
51A
192
199
167A
163A
196
197
198
168A
54
120A
166A
168A
167A
173
190
-192-
173
191
143A
130A
160
165
51A
149
163A
161
181
191A
54A
178
153A
13
177
176
175
162A
164A
143A
191
130A
145A
160
165
182
-182-
180
51A
163A
174
179
181
173
137A
139A
132A
172A 168B
195B
192B
209
153B
216

226
220
221
232
235
233
234
229
230
231
224
227
225
153B
228

192B
51B
209
153A
223
220
222
221
238
234
163B
236
143B
130B
160
165
216
54B
237
161
137B 51B
209
192B
221
220
222
223
190B
163B
191B
143B
130B
160
165
16
216
54B
180B
181B
137B
161

AIR OUT
59
59A
64
65
66
89
90
91
93
95
96
97
98
99
100
106
107

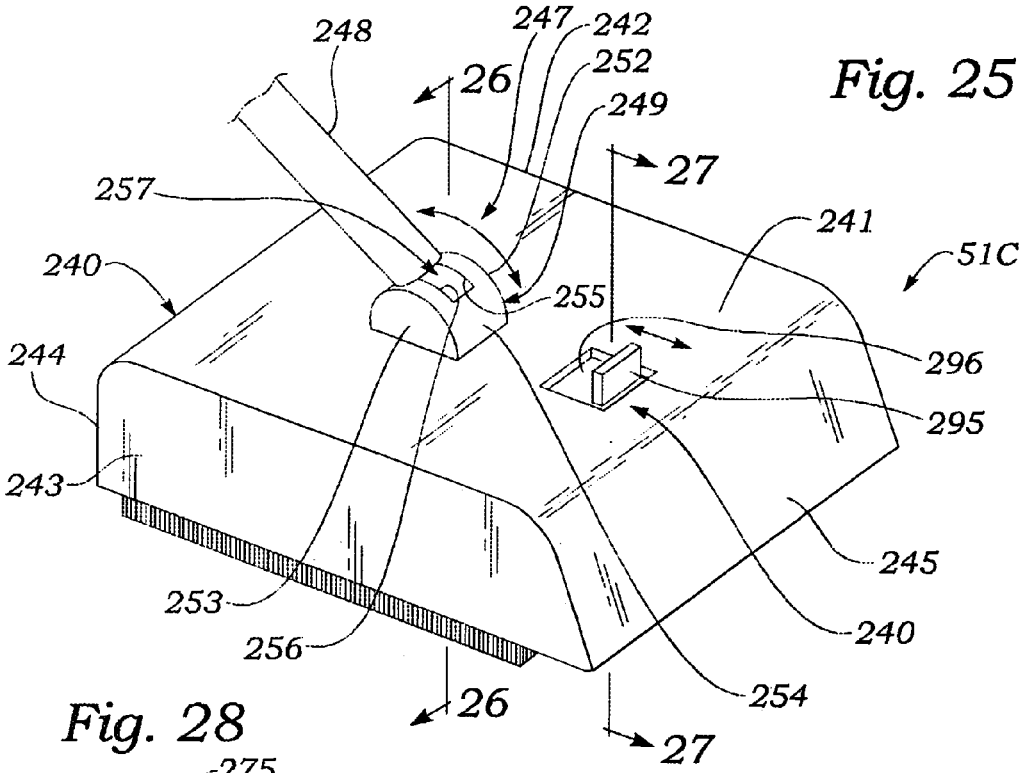
Fig. 25
Fig. 28
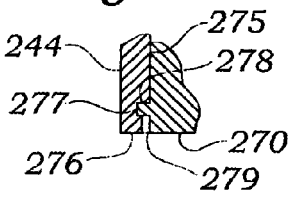
Fig. 26
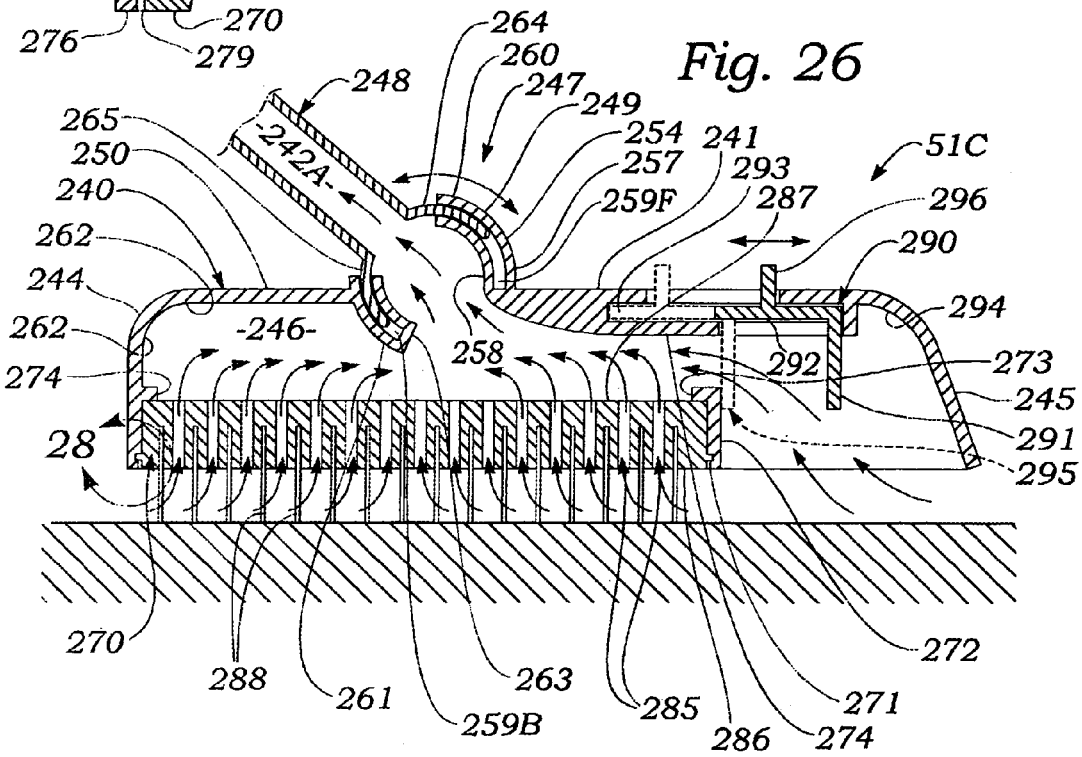

VACUUM BROOM APPARATUS

This is a Continuation-In-Part application of Ser. No. 10/315,956, filed on Dec. 10, 2002, now abandoned.

BACKGROUND OF THE INVENTION

A. Field of the Invention

The present invention relates to devices and apparatus for removing dust and dirt from floors. More particularly, the invention relates to a vacuum broom apparatus which utilizes a synergistic combination of sweeping and vacuuming functions to efficiently remove dirt and dust from floor surfaces while minimizing undesired dispersal of errant dust or dirt particles into the atmosphere.

B. Description of Background Art

Periodic removal of dust, dirt and other debris which accumulates on floors of buildings is performed using a limited variety of well known methods. Thus concrete floors of small industrial or commercial buildings are sometimes washed or hosed down but more typically swept with hand-operated push brooms. Floors of larger buildings are sometimes cleaned using motor-driven rotating brushes which are mounted on a wheeled sweeper apparatus that is pushed by hand, or on a self-propelled sweeper. Dust and dirt accumulated on carpeted surfaces in commercial buildings and residences is typically removed using a vacuum cleaner, which oftentimes includes a wheeled head attachment that includes a rotating brush and a beater bar to agitate carpet fibers and thereby facilitate releasing dirt into a plenum within the head which is subjected to negative pressure produced by a motor-driven blower fan located external to the head.

Vacuum cleaner heads that include motor-driven roller brushes or beater bars and intended for use on carpeted surfaces are generally not well suited for use on hard floor surfaces such as those of tile, concrete, stone or the like. Accordingly, vacuum cleaner kits are typically provided with nozzles of various sizes and shapes which are interchangeably connectable to the lower or outer end of a hollow tubular handle, the upper end of which is coupled through a vacuum hose to a source of negative pressures. Some nozzles which are intended for use on non-carpeted floor surfaces are provided with brush bristles that extend downwardly from a lower surface of the nozzle body, the bristles being arranged in a ring which peripherally encloses a centrally located suction input opening of the nozzle. The brush bristles function as a flexible air dam which makes a partial hermetic seal between the suction input opening of the nozzle and the hard surface of a floor on which the nozzle is drawn across. The bristles also help to dislodge debris particles adhered to a floor surface. However, this dislodging action is problematic because it is confined to a region which peripherally encircles the suction inlet opening of the nozzle, and thus tends to not only inefficiently gather dislodged debris particles, but undesirably scatters a good percentage of the particles into the atmosphere. The present invention was conceived of to provide a vacuum broom apparatus for effectively cleaning floor surfaces while causing a minimal amount of dispersal of dust and dirt into the atmosphere.

OBJECTS OF THE INVENTION

An object of the present invention is to provide a portable vacuum broom apparatus for removing dirt, dust, and other particulate debris from surfaces, primarily of floors.

Another object of the invention is to provide a vacuum broom apparatus which includes a vacuum power unit that is coupled to a cleaner head which includes vacuum inlet passageways that are peripherally arranged with respect to broom or brush bristles.

Another object of the invention is to provide a vacuum broom apparatus which includes a cleaner head that includes a housing or cover shell which has an elastically flexible front wall.

Another object of the invention is to provide a vacuum broom apparatus which includes a cleaner head that has a bulkhead, a broom which protrudes downwardly from the bulkhead, a shroud which peripherally surrounds the bulkhead and broom, and a vacuum passageway located between the broom and a shroud wall, the vacuum passageway having a debris inlet port adjacent to the broom and a debris outlet port connectable to a vacuum source.

Another object of the invention is to provide a vacuum broom apparatus which includes a cleaner head that has a box-like housing which has an open bottom and which includes an elastically flexible front wall, a generally upwardly disposed rear wall, and generally upwardly oriented side walls which are disposed transversely to the front and rear walls, the housing having located therein a vacuum passageway provided with a debris inlet port, and a vacuum source inlet port exterior to the housing.

Another object of the invention is to provide a vacuum broom which includes a height-adjustable broom located with the hollow interior space of hollow vacuum box.

Another object of the invention is to provide a vacuum broom which includes a hollow vacuum box, a broom holder, and a plurality of vacuum passageways provided with debris inlet ports located adjacent to the broom, at least one of which passageways being provided with an air flow control valve.

Another object of the invention is to provide a vacuum broom apparatus which includes a cleaner head that has a generally box-like shape including a hollow interior space which is connected by a hollow swivelable handle to a vacuum source, and a bottom perforated sweeper block which includes a matrix of perforations disposed upwardly from a lower surface of the block to a vacuum plenum space within the head, and a matrix of brush bristles which are interspersed with the perforations and which depend downwardly from the lower surface of the block.

Various other objects and advantages of the present invention, and its most novel features, will become apparent to those skilled in the art by perusing the accompanying specification, drawings and claims.

It is to be understood that although the invention disclosed herein is fully capable of achieving the objects and providing the advantages described, the characteristics of the invention described herein are merely illustrative of the preferred embodiments. Accordingly, I do not intend that the scope of my exclusive rights and privileges in the invention be limited to details of the embodiments described. I do intend that equivalents, adaptations and modifications of the invention reasonably inferable from the description contained herein be included within the scope of the invention as defined by the appended claims.

SUMMARY OF THE INVENTION

Briefly stated, the present invention comprehends a portable vacuum broom apparatus for removing particulate debris including dirt and dust from the surfaces of floors of buildings and other such structures. A basic embodiment of a vacuum apparatus according to the present invention includes a cleaner head which comprises a hollow box-like enclosure that has an open bottom and includes a generally flat rear panel jointed at outer upright side edges thereof to a pair of flat side panels, the side panels being joined at the front edges thereof to a front panel which preferably has a lower forwardly angled curved portion that has a lower transversely disposed horizontal edge. Preferably, at least the lower curved portion of the enclosure is made of an elastically flexible material, thus forming a flexible apron which is capable of forming a relatively air-tight seal with a floor surface against which the apron is pressed down against as the head is pushed or pulled parallel to a surface being cleaned.

Cleaner heads according to the present invention preferably include at least one suction nozzle located within the hollow interior space of the head enclosure, the nozzle having a lower debris entrance opening and a vacuum passageway terminating at the upper end thereof in a vacuum inlet port. In preferred embodiments of cleaner heads according to the present invention, a block-shaped, transversely disposed bulkhead is located within an upper part of the head enclosure, adjacent to the upper inner wall surface of the head enclosure, and joined to the inner surfaces of opposite side walls of the head enclosure.

A basic embodiment of a cleaner head according to the present invention includes a rear suction nozzle which has a generally upright rear wall formed by the inner wall surface of the rear enclosure panel, a front wall formed by a rear surface of the bulkhead, and a generally conically tapered tubular transition section which protrudes upwardly from the upper surface of the enclosure, and terminates in a cylindrically-shaped vacuum inlet tube. A basic embodiment of cleaner head rear nozzle according to the present invention also includes a web which depends downwardly from a rear surface of the bulkhead. The web forms a skirt which spans the width of the hollow interior space of the enclosure, the skirt having a lower transversely disposed edge wall spaced forward of the lower edge wall of the rear enclosure panel and forming therewith and with inner surfaces of opposite side panels of the head enclosure a transversely disposed, generally rectangular-shaped, upwardly disposed debris entrance opening of the rear nozzle.

Basic embodiments of vacuum broom cleaner heads according to the present invention also include a broom which has a neck that is secured within the bulkhead, and downwardly protruding bristles. The body of the broom preferably is symmetrically positioned with respect to the inner wall surfaces of the enclosure panel walls, with the bottom ends of the bristles located at a height approximating that of the bottom edge wall of the front enclosure apron. Optionally, cleaner heads according to the present invention include a telescopically or pivotably adjustable broom neck holder to enable adjusting the height of the broom bristles relative to the apron's lower edge wall. Preferred embodiments of the cleaner heads also include a release mechanism which enables replacement of worn brooms, or their removal for certain applications.

Alternate embodiments of vacuum broom cleaner heads according to the present invention include a front vacuum nozzle located between a rear inner wall surface of the front enclosure panel and a front surface of the bulkhead, and may also include a rear nozzle located rearward of the broom as described above. Other embodiments of vacuum broom cleaner heads according to the present invention include a valve plate which may be slid into a vacuum nozzle passageway to restrict the flow of air streams containing debris to open nozzle passageways, and a broom height adjustment lever optionally combined with a valve actuator lever.

Another embodiment of a vacuum broom cleaner head according to the present invention has a perforated brush block which encloses a portion of a lower entrance opening of the head enclosure, the brush block having a matrix of brush bristles or bundles which protrude downwardly from a lower surface of the block, and which are interspersed with a matrix of perforations that have debris entrance openings in the lower surface of the block, and vacuum inlet openings in the upper surface of the block. The latter communicate with a hollow interior space or plenum of the enclosure, which is connected by a hollow swivelable handle to a vacuum source. Optionally, a front, laterally disposed edge of the brush block is located rearward of the front enclosure panel, the upper front edge forming between an inner surface of the upper panel and side panels of the enclosure a laterally elongated, rectangularly-shaped opening which communicates with the hollow interior space of the enclosure and thus comprises a front vacuum nozzle, which is optionally closable by means of a lever operated, transversely disposed valve plate attached to the upper enclosure panel in a fore-and-aft slidable fashion.

BRIEF DESCRIPTION OF THE DRAWINGS

FIG. 25 is an upper perspective view of a third modification of a cleaner head for the apparatus of FIG. 1.

FIG. 26 is a vertical medial longitudinal sectional view of the head of FIG. 25, taken in the direction of line 26-26 in FIG. 25.

FIG. 28 is a fragmentary view of the head of FIG. 25, showing how a perforated brush block thereof is releasably latched within a bottom opening of a housing thereof.

DESCRIPTION OF THE PREFERRED EMBODIMENTS

FIGS. 1-10 illustrate features of a basic embodiment of a vacuum broom apparatus according to the present invention.

Figures 11, 12, 13:
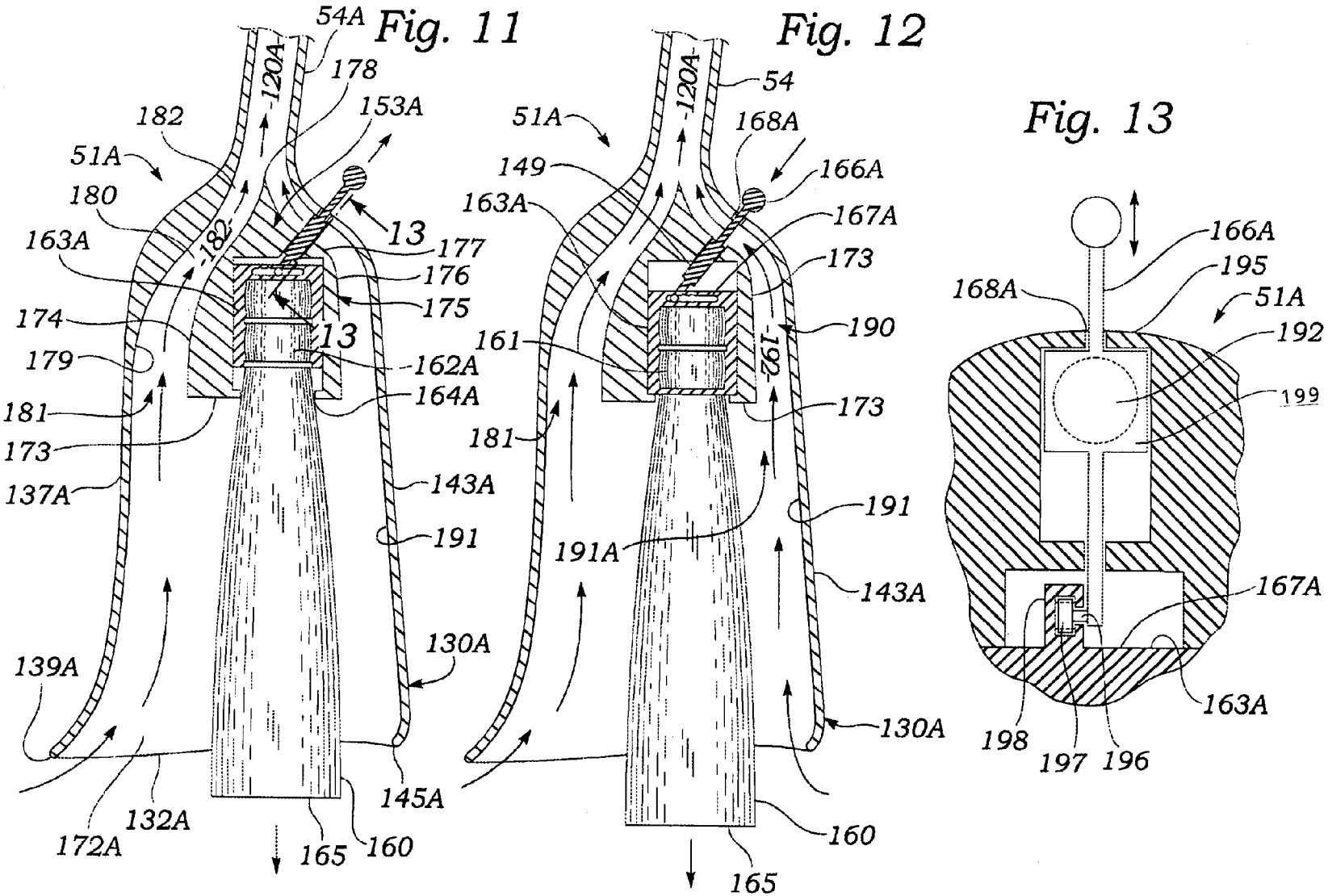
FIG. 11 is a vertical longitudinal sectional view of a first modification of a cleaner head for the apparatus of FIG. 1, in which a rearwardly located broom thereof is adjusted to an upward, retracted position relative to a housing thereof.
FIG. 12 is a view similar to that of FIG. 11, but showing the broom in an extended, lowered position.
FIG. 13 is a fragmentary longitudinal sectional view of the head of FIG. 11 in the direction of line 13-13 in a plane perpendicular to that of FIG. 11, showing a broom height adjusting lever and attached valve plate thereof in an upper, retracted disposition to block air flow.

FIGS. 11-13 illustrate a first modification of a cleaner head for use in the apparatus of FIGS. 1-10.

FIGS. 14-17 illustrate a second modification of a cleaner head.

FIGS. 18-23 illustrate details of a vacuum power unit comprising a component of the apparatus of FIGS. 1-10.

Figures 18, 19, 20, 21, 22, 23, 24:
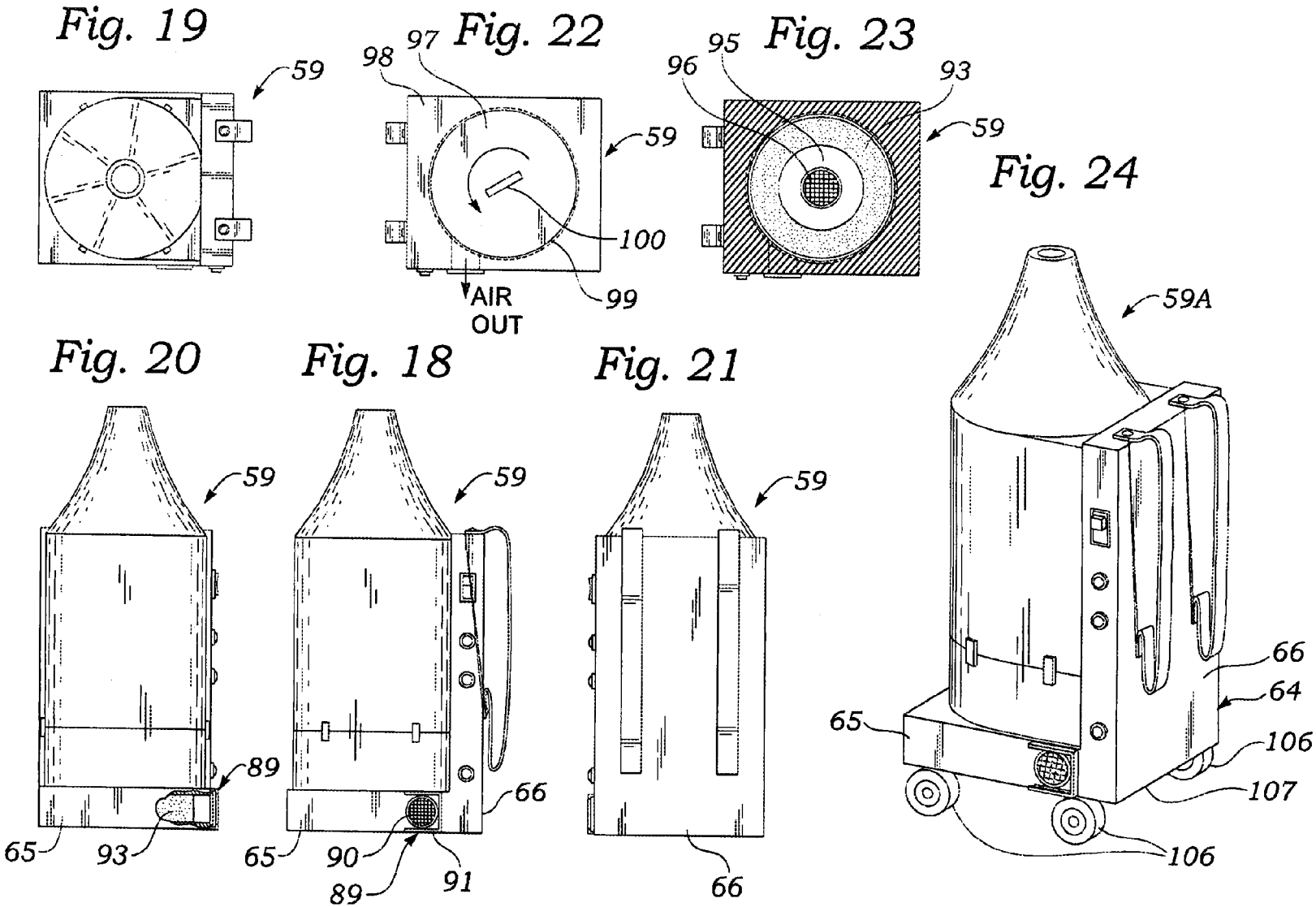
FIG. 18 is a left side elevation view of the vacuum power unit of FIGS. 2 and 3.
FIG. 19 is an upper plan view of the vacuum power unit of FIG. 18.
FIG. 20 is a partly broken away rear elevation view of the vacuum power unit of FIG. 18.
FIG. 21 is a front elevation view of the vacuum power unit of FIG. 18.
FIG. 22 is a lower plan view of the vacuum power unit of FIG. 18.
FIG. 23 is a view similar to that of FIG. 2, but showing a lower cover plate of the vacuum power unit removed.
FIG. 24 is a perspective view of a modification of the vacuum power unit of FIG. 18, which is provided with casters.

FIG. 24 illustrates a modification of the vacuum power unit of FIGS. 18-23.

FIGS. 25-30 illustrate features of a third modification of a cleaner head for use in the apparatus of FIGS. 1-10.

Figure 31:
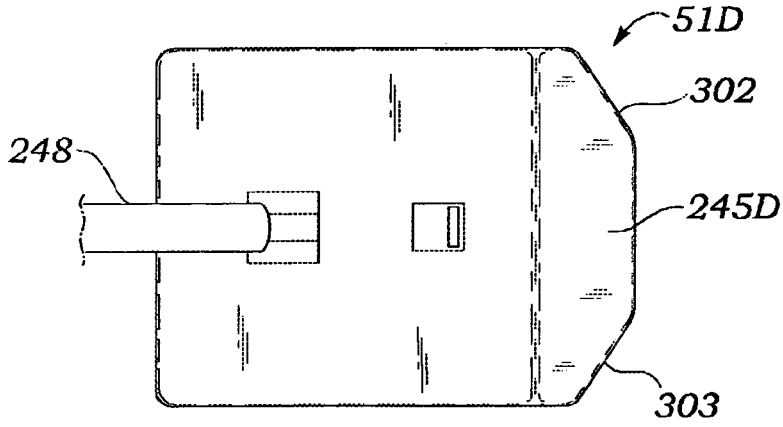
FIG. 31 is an upper plan view of a first modification of the head of FIG. 30.
Figure 32:
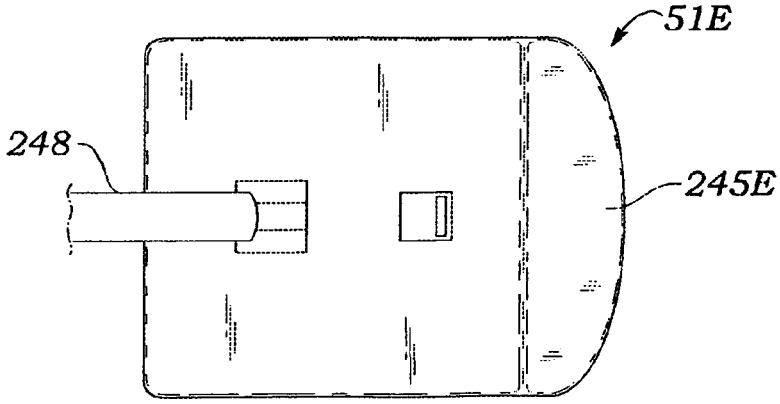
FIG. 32 is an upper plan view of a second modification of head of FIG. 30.

FIGS. 31 and 32 illustrate modifications of the cleaner head of FIGS. 25-30.

Figures 1, 4, 5, 6:
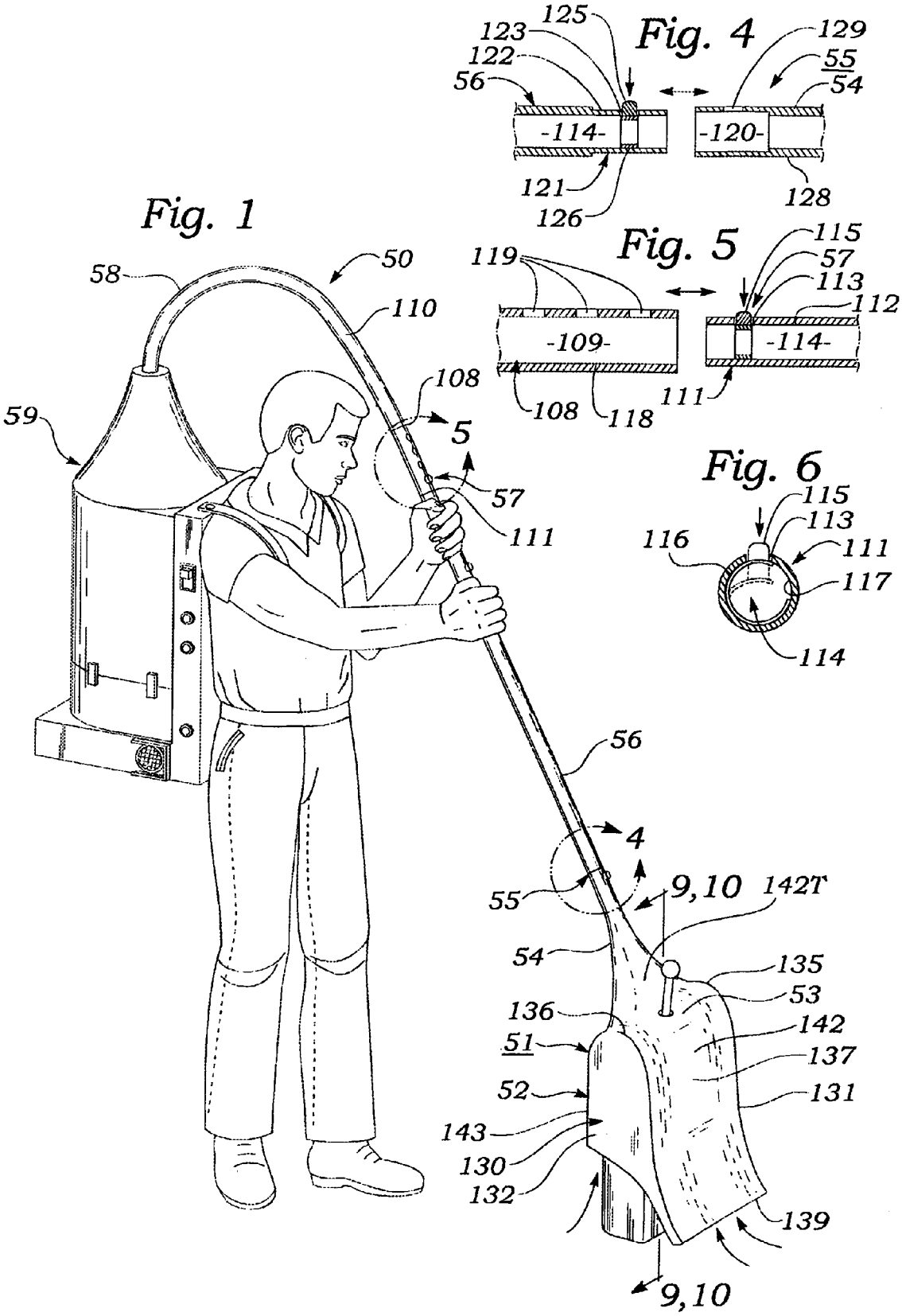
FIG. 1 is a perspective view of a vacuum broom apparatus according to the present invention.
FIG. 4 is a fragmentary longitudinal sectional view of the apparatus of FIG. 1, showing a releasable coupler for removably coupling a cleaner head thereof to a handle thereof.
FIG. 5 is a fragmentary longitudinal sectional view of the apparatus of FIG. 1, showing a telescopically adjustable coupler for coupling the handle thereof to a hose thereof.
FIG. 6 is a transverse sectional view of a spring-loaded detent button mechanism of a type used in both the releasable coupler of FIG. 4 and telescopically adjustable coupler of FIG. 5.
Figure 3:
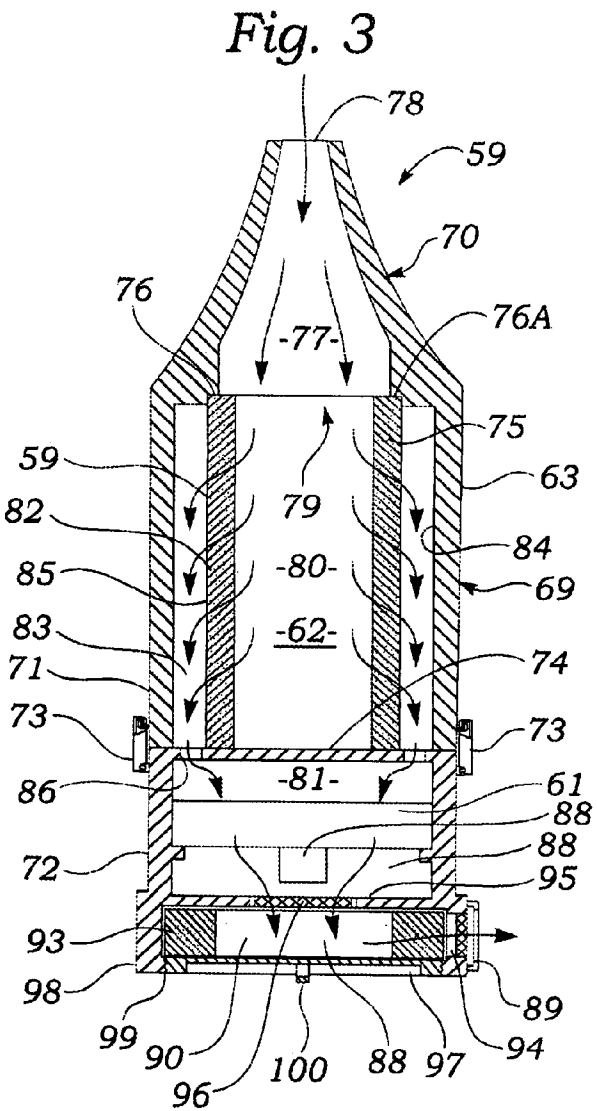
FIG. 3 is a vertical longitudinal sectional view of the vacuum power unit of FIG. 2, taken in the direction of line 3-3 in FIG. 2.
Figure 2:
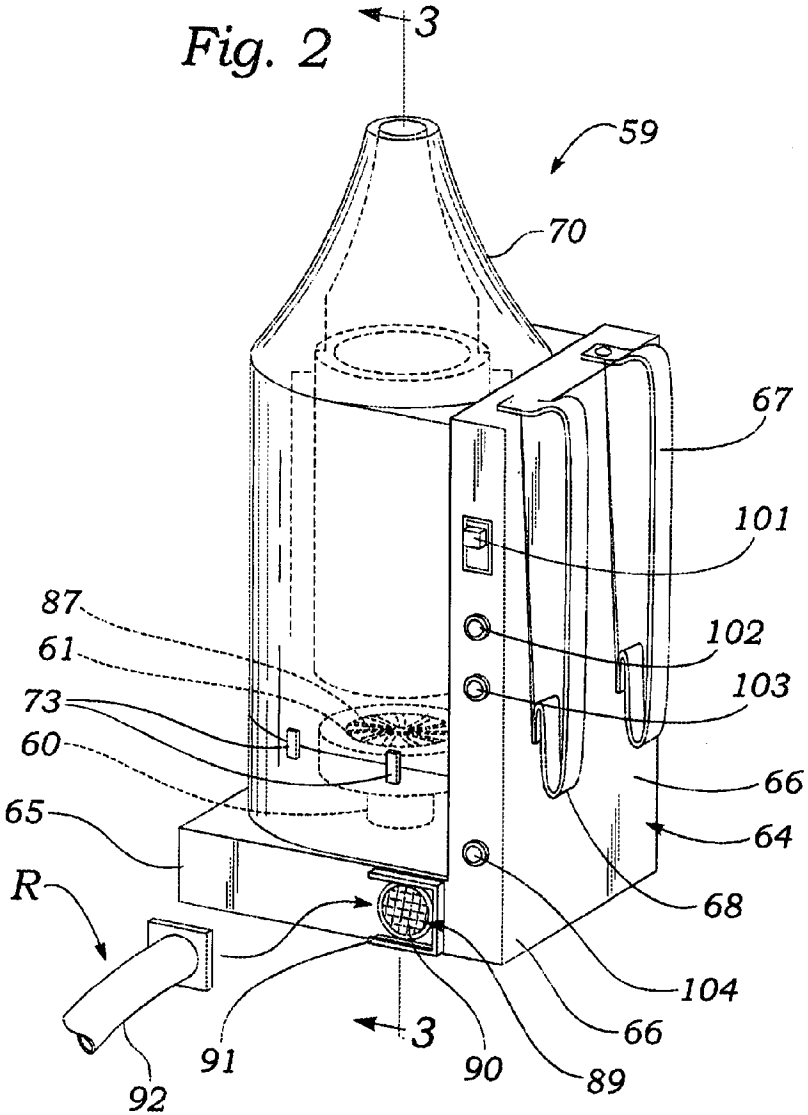
FIG. 2 is a perspective view of a vacuum power unit component of the apparatus of FIG. 1, on an enlarged scale.

FIGS. 1-10 illustrate a basic embodiment 50 of a vacuum broom apparatus according to the present invention. As shown in FIG. 1, apparatus 50 includes a cleaner head 51 which includes a hollow body 52 that has protruding from an upper surface 53 thereof an upwardly and rearwardly angled vacuum inlet tube 54. Vacuum inlet tube 54 is connected by a releasable coupler 55 to the lower end of an elongated hollow tubular handle 56, the upper end of which is connected via a telescopically adjustable coupler 57 to a free end of a vacuum hose 58 which has a fixed end attached to a vacuum power unit 59. As shown in FIGS. 2 and 3 and as will be described in detail below, vacuum power unit 59 includes an electric motor 60 which rotates a fan 61 to produce a negative pressure or partial vacuum within the hollow interior space 62 of a housing 63 of the vacuum power unit, negative pressure being coupled through hose 58 and handle 56 to cleaner head 51.

Referring to FIGS. 18-23 in addition to FIGS. 1-3, it may be seen that vacuum power unit 59 is preferably mounted on a horizontally disposed base 65 of an L-shaped support structure 64 which has an upright member 66 to which are attached a pair of vertically disposed, laterally spaced apart left and right shoulder straps 67, 68 which facilitate transporting the vacuum power unit on a person's back as shown in FIG. 1.

As may be seen best by referring to FIG. 3, vacuum power unit 59 has a hollow, generally cylindrically-shaped base portion 69 surmounted by a hollow, generally frusto-conically-shaped upper end cap portion 70. Preferably, a relatively longer upper portion 71 of cylindrical base portion 69 is fabricated unitarily with upper end cap portion 70, and releasably attached to a relatively shorter lower base portion 72 by a plurality of circumferentially spaced apart toggle latches 73. Short base portion 72 has a circularly-shaped upper bulkhead wall 74 which serves as a base plate for supporting a hollow cylindrically-shaped main dirt filter 75, the upper end 76 of which is received an annular shoulder groove 76A formed in a lower inner surface of upper end cap 70.

As shown in FIG. 3, upper end cap 70 of vacuum power unit 69 has disposed longitudinally therethrough a tapered bore 77 which has an upper entrance opening 78 adapted to insertably receive an end of vacuum hose 58, and lower circular exit bore 79 of larger, diameter which communicates with a blind cylindrical bore 80 of main dirt filter 75. As indicated by the curved arrows in FIG. 3, negative pressure produced in a hollow cylindrical space or upper fan plenum 81 within that portion of base 72 located above fan 61, by rotation of fan 61 draws dirt laden air through entrance bore 78 of vacuum power unit 59, through bores 77, 79, and 80, through passageways 82 in porous main filter 75, through a longitudinally elongated annular space 83 between inner wall surface 84 of housing 69 and outer surface 85 of the filter, through perforations 86 in filter support plate 74, between blades 87 of the fan, into a lower cylindrically-shaped fan plenum 88, and outward through an exhaust port 89 to the atmosphere. As shown in FIG. 2, exhaust port 89 is preferably fitted with a grate 90, and optionally fitted with a hose fitting 91 to which may be attached an exhaust hose 92 for directing an air stream produced by the vacuum power unit to an external location.

As is shown in FIGS. 2, 23 and 20, vacuum power unit 59 may also contain a secondary filter 93 which has a flat annular ring shape adapted to fit into a cylindrically shaped lower vacuum outlet plenum 94 located below lower fan plenum 88. As shown in FIGS. 2, 22 and 23, secondary filter 93 is retained in base portion 72 of vacuum power unit 59 between an upper retainer plate 95 provided with a perforated circular grate 96, and a bottom cover plate 97 which is releasably retained in a bore 99 through bottom base plate 98 of base 72, using a handle 100 which protrudes downwardly from the base plate.

A preferred embodiment of vacuum power unit 59 supplies electrical power from a battery pack (not shown) to fan motor 60 through a power switch 101 located on the on upright 66 of vacuum power unit support structure 64. Also, vacuum power unit preferably includes a red low-battery charge indicator lamp 102, a green full-charge indicator 103, and a charger connection jack 104 for connecting an external power source to the vacuum power unit battery pack.

FIG. 24 illustrates a modification 59A of vacuum power unit 59, which is provided with a plurality, preferably 4, of wheeled casters 106 which are mounted at the corners on a lower surface 107 of support structure base 65.

Referring again to FIGS. 1 and 4-6, it may be seen that flexible vacuum hose 58 has attached to a free end thereof a rigid tubular coupler member 108 which has a longitudinally disposed coaxial bore 109 that communicates with bore 110 of the hose. Bore 109 of tubular member 108 is of the proper diameter to snugly and telescopically receive the upper end 111 of handle 56, which has through a cylindrical wall surface 112 thereof a radially disposed bore 113 that communicates with a longitudinally disposed bore 114 of handle end. As shown in FIG. 6, upper handle end 111 includes a detent button 115 which is urged elastically outwardly within radial bore 113 by a spring 116, which in FIG. 6 is shown to have the shape of a flat leaf that is bent into a circular arc segment forced by spring hoop tension to lodge against circular wall surface 117 of bore 114. Optionally, spring 111 can have the shape of straight cantilevered leaf spring which is disposed longitudinally within bore 114 and secured at an end opposite detent button to wall 112 of upper handle section 111.

As shown in FIG. 5, rigid tubular coupler member 108 of hose 58 has disposed through cylindrical wall 118 thereof a plurality of, longitudinally spaced apart circular holes 119 which are adapted to releasably receive detent button 115, thus enabling handle 56 to be attached to hose 58 with the lower end 55 of the handle adjusted to a desired extension length relative to hose 58.

As shown in FIG. 4, vacuum inlet tube 54 of cleaner head 51 has a bore 120 of the proper diameter to snugly and telescopically receive the lower end 121 of handle 56 which has through a cylindrical wall surface 122 thereof a radially disposed bore 123 that communicates with longitudinally disposed bore 114 of the handle. Lower handle end 121 includes a lower detent button 125 and spring 126, the structure and function of which are exactly analogous to those of upper detent button 115 and spring 120 described above. Thus, when lower tubular end 121 of handle 56 is inserted into bore 120 of cleaner head vacuum inlet tube 54, spring 125 urges detent button radially outwardly to releasably engage a bore 129 disposed radially through cylindrical wall 128 of the vacuum inlet tube.

The structure and function of a basic embodiment 51 of a cleaner head for use in the apparatus 50 shown in FIG. 1 may be best understood by referring to FIGS. 7-10 in addition to FIG. 1.

Figure 7:
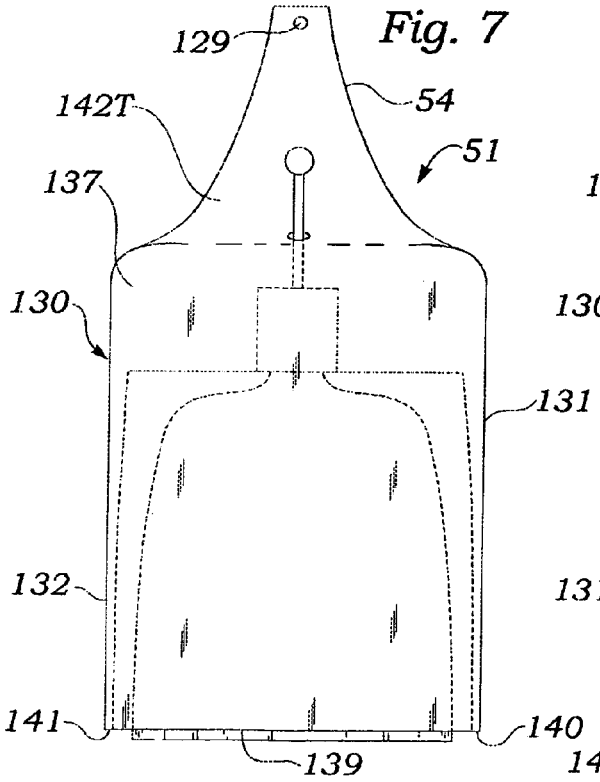
FIG. 7 is a front elevation view of a cleaner head comprising part of the apparatus of FIG. 1.
Figure 8:
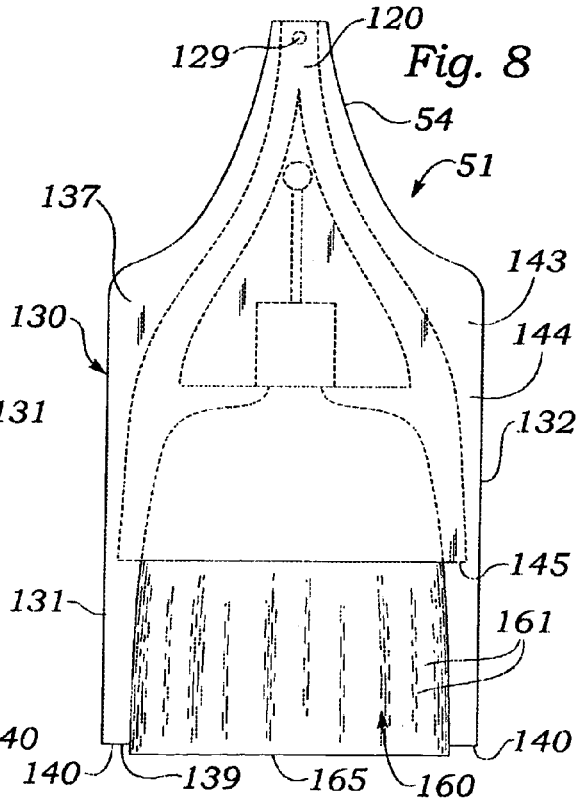
FIG. 8 is a rear elevation view of the cleaner head of FIG. 7.

As shown in FIGS. 1, 7 and 8, body 52 of cleaner head 51 includes a hollow box-like enclosure or housing 130 which has generally flat, parallel, vertically disposed left and right side wall panels 131, 132. As shown in FIG. 1, left and right side wall panels 131, 132 each has a lower portion 133, 134, respectively, which has a shape approximating that of a vertically elongated rectangle, modified by a convex, arcuately curved upper edge wall 135, 136, respectively. Housing 130 also has a front wall panel 137 which is disposed transversely to left and right side wall panels 131, 132. Front panel 137 has the shape approximating that of a sinuously curved vertically elongated rectangular plate which is relatively longer than left and right side wall panels 131, 132. Front wall panel 137 has a lower concavely curved portion 138 which has transversely disposed edge wall 139 that protrudes below lower edge walls 140, 141, respectively, of the left and right side wall panels. Front wall panel 137 also has a relatively straight intermediate portion 142, and a convex, arcuately curved upper end portion 142T which is disposed transversely to upper edge walls 135, 136 of left and right side panels 131, 132, and which comprises a major portion of an upper cover panel of enclosure 130.

Figure 9:
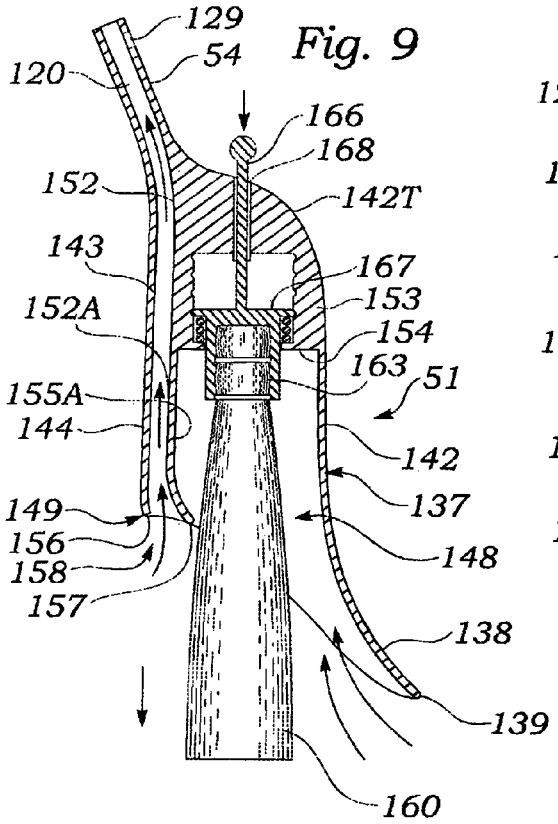
FIG. 9 is a vertical longitudinal sectional view of the cleaner head of FIGS. 7 and 8, taken in the direction of line 9-9 in FIG. 1 and showing a broom component of the head in a lowered, extended position relative to a housing component of the head.

As may be seen best by referring to FIGS. 7, 8 and 9, enclosure 130 of cleaner head 51 has a generally flat rear wall panel 143 which has a lower vertically elongated rectangular-shaped portion 144 that is disposed transversely to left and right side panels 131, and has a lower edge wall 145 joined to lower edge walls 146, 147, respectively, of the side wall panels.

In a preferred embodiment of cleaner head 51, at least lower concavely curved portion 138 of front wall panel 137 is made of an elastically flexible material, such as and elastic or elastomeric polymer, e.g., polyethylene.

Figure 10:
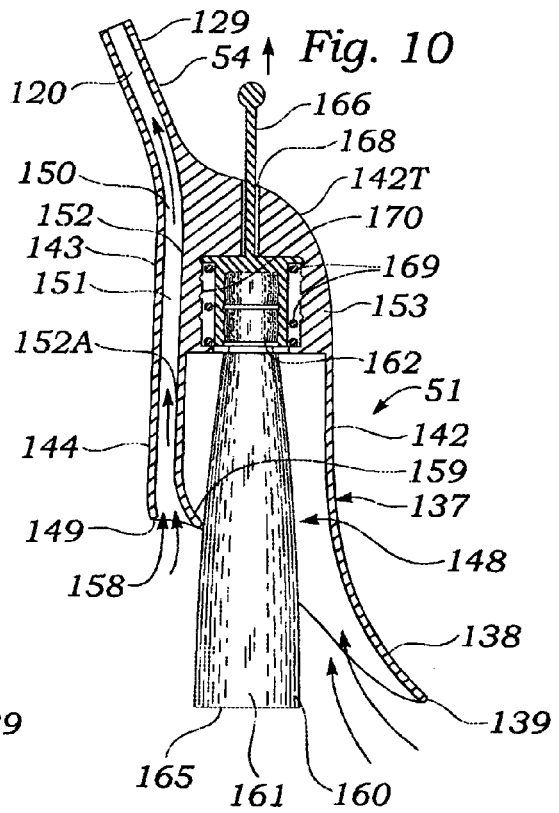
FIG. 10 is a view similar to that of FIG. 9, but showing the broom in a raised, retracted position.

As shown in FIGS. 9 and 10, cleaner head 51 has a hollow interior space 148 formed between inner surfaces of the front, rear and side wall panels of enclosure 130. Also, cleaner head 51 preferably has at least one vacuum nozzle, e.g., a rearwardly located vacuum nozzle 149, which has a bore 150 that communicates with bore 120 of vacuum inlet tube 54. As is also shown in FIGS. 9 and 10, rear vacuum nozzle 149 is formed by an elongated space 151 located between inner surfaces of rear wall panel 143, left and right side wall panels 131, 132, and the rear wall surface 152 of a block-shaped bulkhead 153 which is disposed transversely between the side wall panels and front wall panel 137. In a preferred embodiment, bulkhead 153 has protruding downwardly from a lower transversely disposed surface 154 thereof a thin, generally rectangular shaped plate-like web which forms a skirt 155 that has a rear surface 152A which is continuous with rear surface 152 of the bulkhead, and a front surface 155A which is parallel to the rear surface of the skirt. Formed between a lower transverse edge wall 156 of rear wall panel 143 and a lower transverse edge wall 157 of skirt 155 is a generally rectangularly-shaped laterally elongated debris entrance opening 158 of nozzle 149. Referring still to FIGS. 9 and 10, lower edge wall 157 of skirt 155 preferably is angled or most preferably arcuately curved forward towards open space 148 of cleaner head 51.

Referring now to FIGS. 1 and 7-10, it may be seen that cleaner head 51 of vacuum broom apparatus includes a brush or broom 160 which is formed of a vertically disposed laterally elongated bundle of bristles 161, upper ends of which are compressed together to form a shorter, vertically elongated generally cylindrically-shaped neck 162. Neck 162 is preferably mounted in bulkhead 153 by a releasable mount so that broom 160 can be readily replaced when worn out, or when it is desired to use cleaner head 51 without the presence of a broom. Thus, as shown in FIGS. 9 and 10, neck 162 of broom 160 is releasably fastened within a mounting bushing 163, that is telescopically slidably mounted within a blind bore 164 disposed vertically through a central portion of bulkhead 153, to enable the height of the lower sweeping surface 165 of broom 160 to be adjusted to a desired value relative to lower edge wall 139 of front wall panel 137. As shown in FIGS. 9 and 10, a mechanism for adjusting the height of broom 160 includes a push rod 166 which protrudes upwardly from upper surface 167 of mounting bushing 163, through a through-bore 168 in upper wall surface 142T of housing 130. Optionally, a helical compression spring 169 may be positioned coaxially over bushing 153 and between inner wall surface 170 of bore 169, to retain broom 160 in an upwardly biased position.

FIGS. 11-13 illustrate a first modification 51A of the cleaner head 51 shown in FIG. 1 and described above. As shown in FIG. 11, modified cleaner head 51A has a bulkhead 153A disposed transversely between inner surface 172A of right side wall 132A and the inner surface of the left side wall (not shown) which has a more generally triangular or wedge-like vertical longitudinal cross-sectional shape than that of bulkhead 153 of cleaner head 51 shown in FIGS. 9 and 10. Thus, as shown in FIG. 11, bulkhead 153A has a generally flat, transversely disposed horizontal bottom surface 173, and a front rearwardly upwardly angled and curved wall surface 174. Bulkhead 153A also has a rear surface 175 which includes a transversely disposed generally vertical lower portion 176, and a forwardly and upwardly angled portion 177, which intersects front bulkhead wall surface 174 to form a generally triangular-shaped, transversely disposed vertex 178.

Front surface 174 of bulkhead 153A is spaced rearwardly of inner surface 179 of front panel wall 137A, forming therebetween a front nozzle 180 which has a lower transversely disposed horizontal debris entrance opening 181 that is coplanar with bottom surface 173 of bulkhead 153A. Front nozzle 180 also has a sinuously curved duct passageway 182 which communicates at a lower end thereof with debris opening 181 and at an upper end thereof with bore 120A of vacuum inlet tube 54A.

Referring still to FIGS. 11 and 12, it may be seen that modified cleaner head 51A includes a rear nozzle 190 formed between inner surface 191 of rear wall panel 140A, and rear surface 175 of bulkhead 153A. Rear nozzle 190 has a lower transversely disposed debris entrance opening 191 which is coplanar with bottom surface 173 of bulkhead 153A. Rear nozzle 190 also has a sinuously curved rear nozzle duct passageway 192 which communicates at a lower end thereof with debris entrance opening 191A and at an upper end thereof with bore 120A of vacuum inlet tube 54A.

As shown in FIGS. 11 and 12, modified cleaner head 51A includes a broom 160 which has a neck 162A that is mounted in a bushing 163A which is telescopically slidably held within a blind bore 164A in the lower part of bulkhead 153A.

Referring to FIG. 13 in addition to FIGS. 11 and 12, it may be seen that bushing 163A is telescopically movable within bore 164A of bulkhead 153A by means of a push rod 166A which protrudes upwardly through a hole 168A through upper wall surface 195 of housing 130A. Lower end 196 has protruding laterally therefrom a vertically disposed wheel 197 which is rollable in fore-and-aft directions within a slotted track 198 disposed in a fore-and-aft direction on the upper surface 163A of bushing 163A. The push rod, wheel and track constitute a mechanism which enables longitudinal motion of push rod 166A, which is angled with respect to the vertical axis of bushing 163A, to effect vertical up and down motion of the bushing and attached broom 160. As shown in FIGS. 11-13, push rod 166A preferably has attached to an intermediate longitudinal part thereof a flat valve plate 199, which obstructs rear nozzle duct 192 when the push rod is in an upwardly retracted position, and which unblocks the passageway when the push rod is in its downwardly depressed position.

Figures 14, 15, 16, 17:
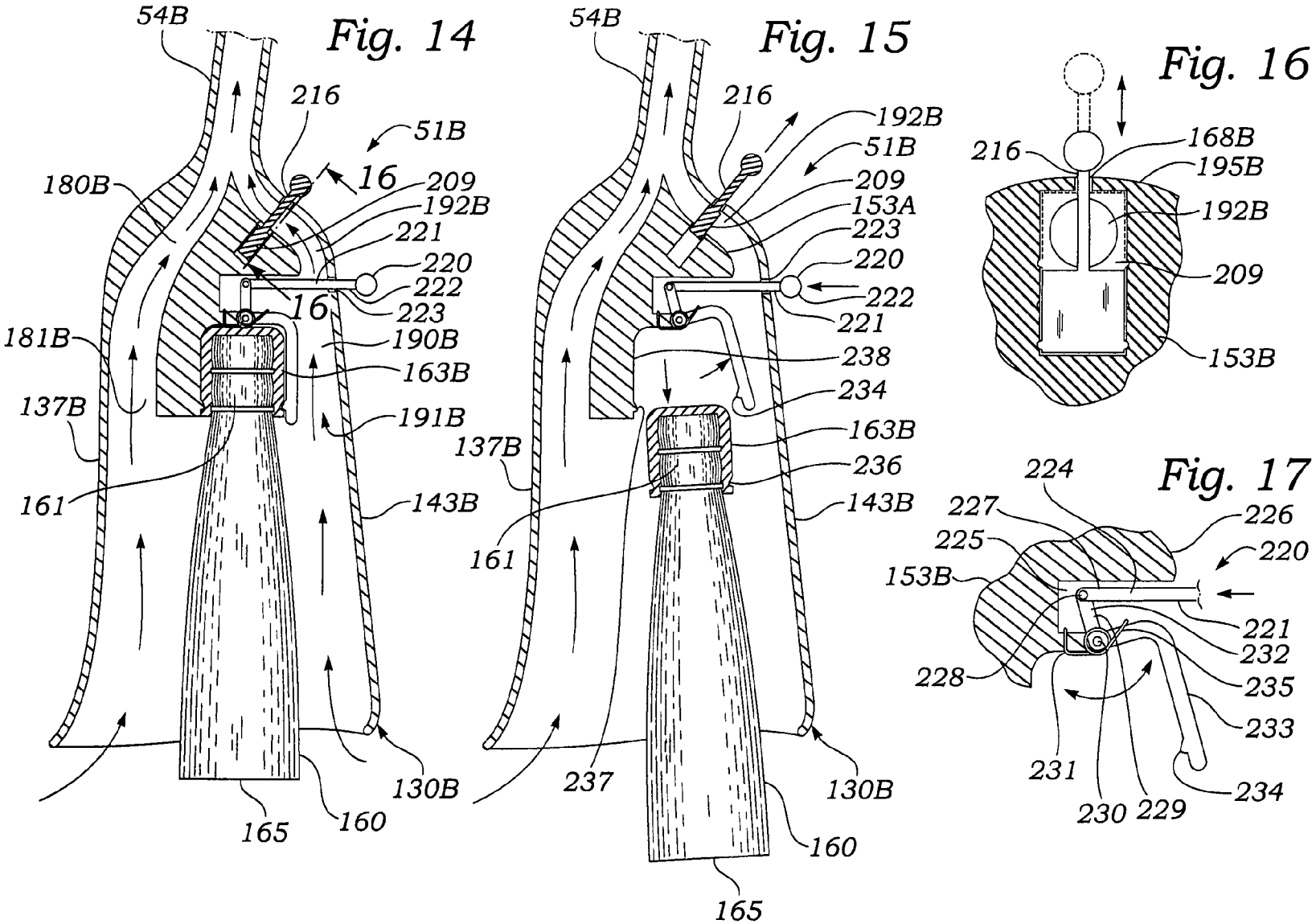
FIG. 14 is a vertical longitudinal sectional view of a second modification of a cleaner head for the apparatus of FIG. 1, in which a valve plate thereof is adjusted to a downwardly extended disposition which permits air flow through a passageway of the valve.
FIG. 15 is a view similar to that of FIG. 14, but showing the valve plate retracted upwardly to block air flow, and showing a broom holder mechanism thereof adjusted to a release position.
FIG. 16 is a fragmentary longitudinal sectional view of the head of FIG. 14 taken in the direction of line 16-16 in a plane perpendicular to that of FIG. 14, showing a valve adjustment lever and attached valve plate thereof in a lower, extended position to permit air flow.
FIG. 17 is a fragmentary vertical longitudinal sectional view of the head of FIG. 14, showing a broom holder mechanism thereof on an enlarged scale.

FIGS. 14-17 illustrate a second modification 51B of a cleaner head 51 according to the present invention. As shown in FIGS. 14-16, modified cleaner head 51B includes a valve plate 209 which is mounted on the lower end of a push rod 216 that is disposed upwardly through a hole 168B through upper surface 195B of enclosure 130B of the cleaner head. When push rod 216 is retracted fully upwards, valve plate 209 blocks air flow through rear vacuum nozzle passageway 192B, and when the push rod is depressed fully downwards, the rear vacuum nozzle passageway is unobstructed.

As shown in FIGS. 14-17, modified cleaner had 51B also includes a releasable broom holder mechanism 220 which facilitates removing and replacing a broom 160 from the head. As shown in FIGS. 14-17, releasable broom holder mechanism 220 includes a lever arm 221 which has a rear portion 222 that protrudes horizontally rearwardly through a hole 223 in rear wall panel 143B of cleaner head enclosure 130B. Lever arm 221 also has a front portion 224 which protrudes forwardly into a cavity 225 formed in rear surface 226 of bulkhead 153B, where an inner end 227 of the lever arm is connected by an upper pivot pin 228 to the upper end of a downwardly disposed bell crank arm 229. A lower end of bell crank arm 229 is pivotably fastened at a lower end thereof by a lower pivot pin 230 to a lug 231 which protrudes rearwardly from bulkhead 131. Bell crank arm 229 has protruding perpendicularly from a short upper portion 232 thereof an inverted L-shaped arm 233. The latter is provided at the lower end with a forward protruding tang 234. Lower L-shaped arm 233 of bell crank arm 229 is urged to a vertical position by a torsion spring 235, whereby tang 234 is urged forward into locking engagement within an annular groove 236 formed in the outer wall surface of broom holder bushing 163B, near the lower end thereof. The forward directed force exerted on broom holder bushing 163B also urges a front part of annular bushing groove 236 into locking engagement by a front wall tang 237 which protrudes rearwardly from a rear wall surface 238 of bulkhead 153B.

FIGS. 25-32 illustrate a third embodiment of a vacuum broom cleaner head 51C for use within vacuum broom apparatus 50 of FIG. 10.

As shown in FIGS. 25-29, vacuum cleaner head 51 includes a housing 240 which has the shape of a short, generally rectangularly-shaped box which includes a generally flat, rectangularly-shaped upper wall panel 241 that has protruding perpendicularly downwardly therefrom left and right flange walls 242, 243 which have a generally rectangular shape elongated in a fore-and-aft direction. Housing 240 also has a rear flange wall 244 which has a laterally elongated, generally rectangular shape and which protrudes generally perpendicularly downwards from a rear edge of upper wall panel 240. Housing 240 also has a front generally rectangularly-shaped, laterally elongated wall panel 245 which angles forward obliquely from a front edge of upper wall panel 241.

As shown in FIG. 26, housing 240 of cleaner head 51C a hollow interior space 246 which has a shape approximating that of a short rectangularly-shaped block. Hollow interior space 246 functions as a vacuum plenum in which the air pressure therein is reduced below atmospheric pressure when the plenum is coupled to a source of negative pressure such as a vacuum pump. Thus, vacuum broom cleaner head 51 includes a swivelable union 247 for hermetically coupling plenum 246 of housing 240 to the bore 248A of an elongated hollow tubular handle 248, which is in turn hermetically coupled to a vacuum source such as vacuum hose 58, as shown in FIG. 1.

As shown in FIGS. 25 and 26, swivelable union 247 for coupling handle 248 to housing 240 of cleaner head 51 includes a generally semi-cylindrically-shaped, bifurcated saddle boss 249 which has a longitudinal axis parallel to the upper surface 250 of upper housing wall panel 241. As may be seen bests by referring to FIG. 26, saddle boss 249 has left and right parallel laterally spaced apart semi-cylindrically shaped halves 252, 253 which are joined together by a front web 254, and formed between opposed inner facing left and right vertical wall surfaces 255, 256, thereof a vertical slab-shaped slot 257.

As shown in FIG. 26, saddle boss 249 has in a vertical longitudinal section the shape of a cylindrical shell, including an outer cylindrical wall 257, and a coaxial inner wall 258 spaced radially inwardly from the outer cylindrical wall to form between the walls a pair of front and rear cylindrically-shaped grooves 259F, 259B. As is also shown in FIG. 26, boss 249 is bisected into two circumferentially-spaced apart sectors, including a front semi-cylindrically shaped sector 260 which protrudes upwardly from upper surface 250 of upper wall panel 241, and a circumferentially spaced apart rear semi-cylindrically shaped sector 261 which is located rearward of the front sector. As shown in FIG. 26, rear sector 261 protrudes below lower surface 262 of upper wall panel 241, and has a laterally disposed end wall 263 which joins outer and inner semi-cylindrically shaped walls 257, 258 and closes rear groove 259B therebetween.

As is also shown in FIG. 26, tubular handle 248 of cleaner head 51C has formed in a front, lower end thereof front and rear semi-cylindrically shaped flanges 264, 265 which fit relatively tightly but swivelably within front and rear semi-cylindrically shaped grooves 259F, 259B, respectively. Thus constructed swivelable union 249 enables handle 248 to be swivelled in a vertical plane relative to housing 240 of cleaner head 51C, communicating negative pressure from bore 248A of the handle to hollow interior space or plenum 246 of the cleaner head.

Figure 29:
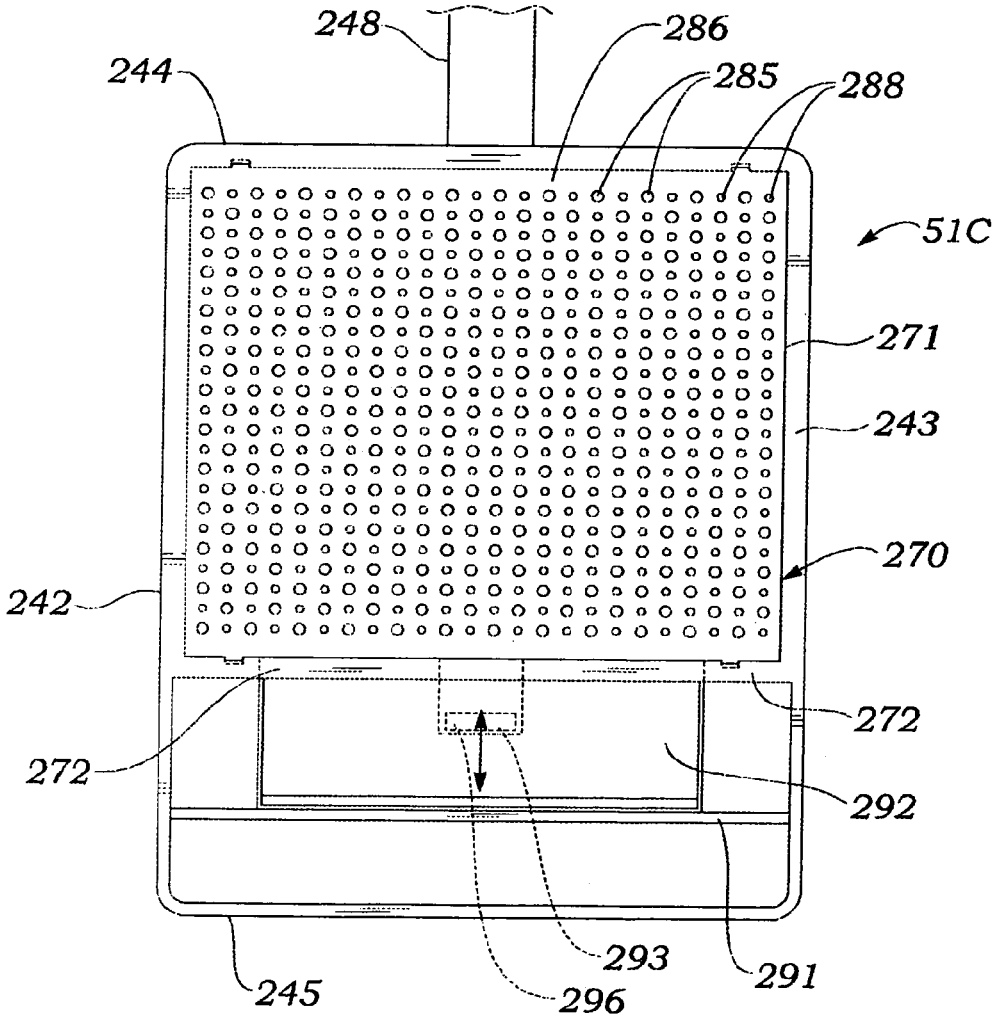
FIG. 29 is a lower plan view of the head of FIG. 25.
Figure 30:
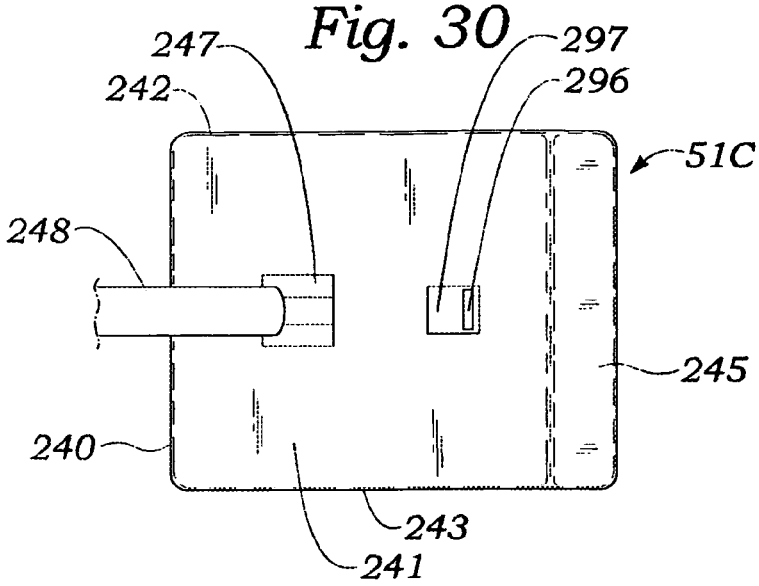
FIG. 30 is an upper plan view of the head of FIG. 25.

As may be seen best by referring to FIGS. 26-29, cleaner head 51C includes a generally rectangularly-shaped brush block 270 which is mounted in a lower rectangularly-shaped opening 271 of housing 240. As shown in FIG. 29, bottom opening 270 of housing 240 is preferably coextensive with a rectangularly-shaped space formed between inner wall surfaces of left, right and rear flange walls 242, 243, 244, respectively, but is spaced rearward from front lower wall and closed by a transversely disposed, inverted and reversed L-shaped vertical inner flange wall 272 which is disposed transversely between inner wall surfaces of left and right flange walls 242, 243.

As shown in FIG. 26, inner flange wall 272 has at the upper end thereof a rearwardly protruding transversely disposed, horizontal front retainer rib 273 which is vertically aligned with transversely disposed rear retainer rib 274 that protrudes forward from inner wall surface 275 of rear flange wall 244. The fore-and-aft spacing between opposed vertical faces of front and rear retainer ribs 273, 274 is less than the fore-and-aft length of brush block 270, thus providing ledges which limit upward motion of the brush block into opening 270.

As is shown in FIGS. 26 and 28, inner front facing wall surface 275 of rear flange wall 244 has formed therein a short distance above lower edge wall 276 of the rear flange wall, a transversely disposed rectangular cross-section groove 278. Rear flange wall 244 is made of an elastically deformable material, and may be flexed rearwardly to enable groove 278 to receive and elastically retain a transversely disposed rib 278 which protrudes rearwardly from rear surface 279 of brush block 270. Also, front surface 280 of brush block 270 has protruding therefrom a transversely disposed, rectangular cross-section rib 281 which is elastically engaged within a groove 282 formed in rear wall surface 283 of inner elastically flexible flange wall 273.

Figure 27:
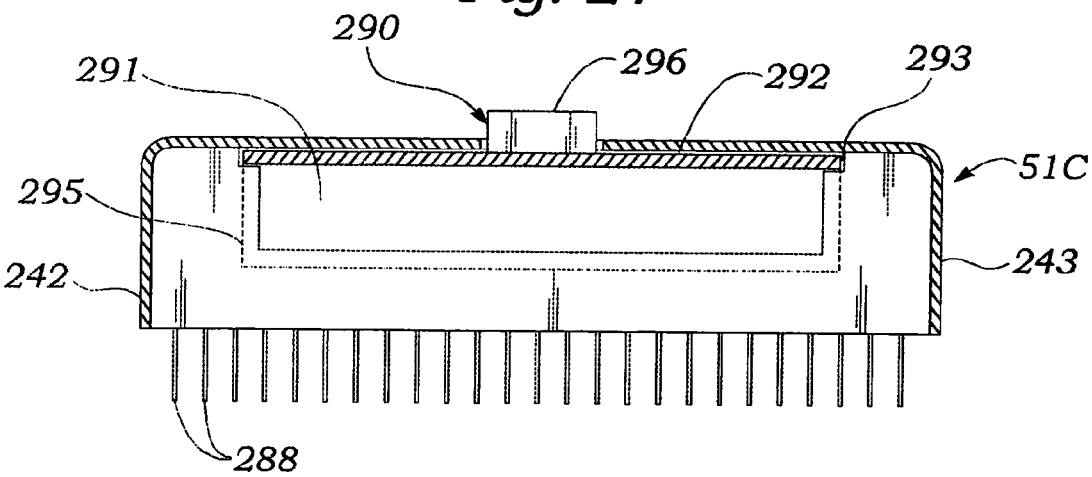
FIG. 27 is a transverse vertical longitudinal sectional view of the head of FIG. 27, taken in the direction indicated by the line 27-27 in FIG. 25.

As shown in FIGS. 26, 27 and 29, brush block 270 has formed through its thickness dimension a plurality of vacuum passageways 285 which penetrate lower surface 286 and upper surface 287 of the brush block. As shown in FIG. 29, vacuum passageways 285 are arranged in a rectangular matrix which is coextensive with bottom surface 286 of brush block 270. Brush block 270 also includes a plurality of bristle fibers 288 which protrude downwardly from lower surface 286 of the brush block. As shown in FIG. 29, bristles 288 are arranged in a rectangular matrix of location points which are interspersed with those of vacuum passageways 285, thus resulting in a composite rectangular matrix in which bristles alternate with vacuum passageways.

Referring to FIGS. 25-29, it may be seen that cleaner head 51C may optionally be provided with a transversely disposed valve 290 which has a transversely disposed vertical valve plate 291, located in bottom open space 246 of housing 240, rearward of front flange wall 245. Valve 290 includes in addition to valve plate 291 an upper horizontally disposed leg 292 which is slidable fore-and-aft in a slot 293 formed between lower inner surface 294 of upper wall panel 241, and a web 294 disposed underneath a front portion of upper wall panel 241. Valve plate 291 is movable from a forward position, which unblocks a rectangularly-shaped front nozzle opening 295 to plenum 246, to a rearward, closer position, by means of vertically disposed lever arm 296 which protrudes upwardly from upper horizontal leg 292 of valve 290, through a rectangularly-shaped perforation 297 provided through upper wall panel 241.

FIG. 31 illustrates a modification 51D of cleaner head 51C, in which front flange wall 245D thereof has left and right sides 302, 303 which angle forwardly and rearwardly towards center line of the front flange wall. FIG. 32 illustrates another modification 51E of cleaner head 51C, in which sides of front flange wall 51E thereof have convex, arcuately curved shapes.

What is claimed is:

1. In a vacuum cleaner head, said head including a housing having an upper wall and a shroud which protrudes downwardly from said upper wall, said shroud having a rear wall, a pair of laterally spaced apart side walls and a front wall spaced forward of said rear wall, the improvement comprising a broom block which at least partially obstructs a rear portion of a lower entrance opening to a hollow interior space within said head which communicates with a vacuum plenum within said head, said block having a lower surface from which bristles arranged in a first matrix protrude downwardly, an upper surface which communicates with said vacuum plenum, and a plurality of vacuum passageways disposed between said lower and upper surfaces of said broom block, said vacuum passageways being interspersed with said bristles, said block having a front transversely disposed edge wall located rearwards from said front shroud wall to thus form between said front transversely disposed edge wall of said block and said front shroud wall, a front hollow portion of said interior space forward of said bristles, said front hollow portion of said interior space having a lower opening coextensive with a front portion of said lower entrance opening, and a valve which has a valve plate operable in a first direction in said housing to obstruct air flow between said front portion of said hollow interior space of said housing adjacent to an edge of said block and operable in a second direction away from said edge of said block to enable air flow between said front portion of said lower entrance opening of said housing and said hollow interior space thereof.

2. An apparatus for removing debris particles from a surface, said apparatus comprising;

a. a housing having an interior space which is at least partially hollow and has at least a partially unobstructed lower entrance opening which communicates with said interior space, said housing having an upper wall and a shroud which protrudes downwardly from said upper wall and which at least partially encircles said hollow interior space, said shroud having a rear wall, a pair of laterally spaced apart side walls, and a front wall spaced forward of said rear wall, b. a vacuum inlet port having a bore which communicates at a lower end thereof with said interior space, c. a vacuum source connectable to said vacuum inlet port of said housing, d. a downwardly protruding broom which has an upper end located within said hollow interior space of said housing and downwardly protruding bristles, e. said broom comprising in combination a block which at least partly obstructs a rear portion of said lower entrance opening of said housing, said block having a lower surface from which bristles arranged in a first matrix protrude downwardly, an upper surface which communicates with said hollow interior space of said housing, and a plurality of vacuum passageways disposed between said lower and upper surfaces of said block, said vacuum passageways being arranged in a second matrix interspersed with said bristles, said block having a front transversely disposed edge wall located rearwards from said front shroud wall to thus form between said front transversely disposed edge wall of said block and said front shroud wall a front hollow portion of said interior space forward of said bristles, said front hollow portion of said interior space having a lower opening coextensive with a front portion of said lower entrance opening, and f. a valve which has a valve plate operable in a first direction in said housing to obstruct air flow between said front portion of said hollow interior space of said housing adjacent to an edge of said block, and operable in a second direction away from said edge of said block to enable air flow between said front portion of said lower entrance opening of said housing and said hollow interior space thereof.

3. The apparatus of claim 2 further including a pivotable union for pivotably joining said vacuum inlet port to a hollow tubular handle, said pivotable union enabling pivotable motion of said handle in a plane disposed longitudinally through said handle.

4. The apparatus of claim 3 wherein said pivotable union includes in combination a boss which protrudes upwardly from said upper wall of said housing, said boss having therein a socket having a hollow interior space and a lower entrance opening which communicates with said hollow interior space of said housing, and an upper entrance opening comprising a rectangular cross-section slot which pivotably holds therewithin a hollow body having a lower entrance opening which communicates with said hollow interior space of said socket and an upper opening which communicates with a bore of a hollow tubular handle.

* * * * *